United States Patent [19]

Ganz

[11] 4,264,401

[45] Apr. 28, 1981

[54] WEB SPLICER

[75] Inventor: Robert H. Ganz, Saddle River, N.J.

[73] Assignee: Ganz Brothers, Inc., Bergenfield, N.J.

[21] Appl. No.: 735,793

[22] Filed: Oct. 22, 1976

[51] Int. Cl.[3] ..... B65H 19/18

[52] U.S. Cl. ..... 156/504; 156/505; 242/58.1; 242/58.5

[58] Field of Search ..... 156/504, 502, 505, 157; 242/58.2, 58.5, 58.6, 58.3, 58.4, 58.1; 271/246

[56] References Cited

U.S. PATENT DOCUMENTS

| | | | |
|---|---|---|---|
| 2,940,507 | 6/1960 | Butler, Jr. | 156/504 |
| 3,602,497 | 8/1971 | Fawdry | 271/246 |
| 3,880,698 | 4/1975 | Kawazura et al. | 156/504 |
| 4,170,506 | 10/1979 | Marschke | 156/50 X |

*Primary Examiner*—Michael W. Ball
*Attorney, Agent, or Firm*—Charles E. Brown

[57] ABSTRACT

This disclosure relates to a web splicer wherein a running web is fed between two rolls into a nip therebetween and wherein a new web is joined to the running web in the nip by means of a joining strip which has a pressure sensitive adhesive on one face thereof, the joining strip being secured to the new web in projecting relation therefrom. The rolls are provided with grooves and a make-ready unit for the new web includes a support having fingers for positioning the splice strip with the fingers being movable down into the associated roll in grooves therein to present the joined strip and the new web to the associated roll. Detector means are provided for detecting the end of the running web and support positioning means are actuated by the detector to position the new web relative to the rolls. There is also provided a suitable support for a roll of web, the support permitting the roll to be mounted when the spindle thereof is in a readily accessible horizontal position at one side of the machine and to be positioned in a higher horizontal position overlying the machine.

12 Claims, 8 Drawing Figures

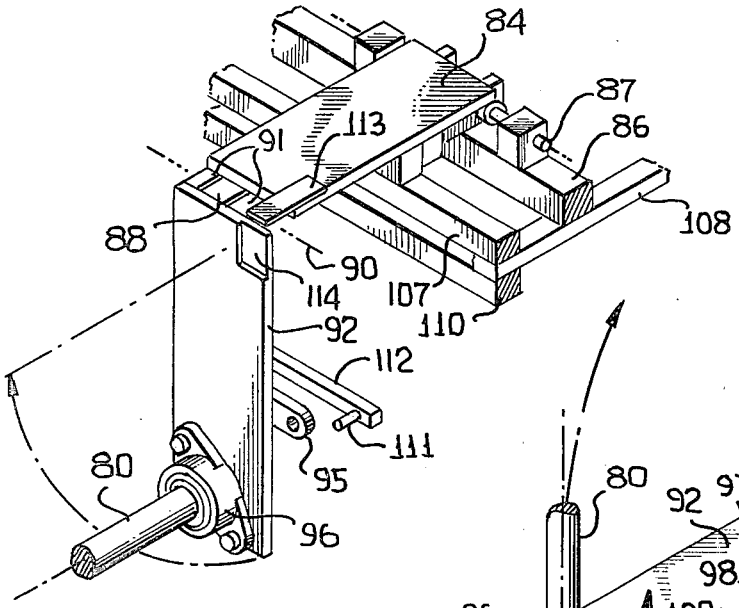
FIG.4
FIG.3
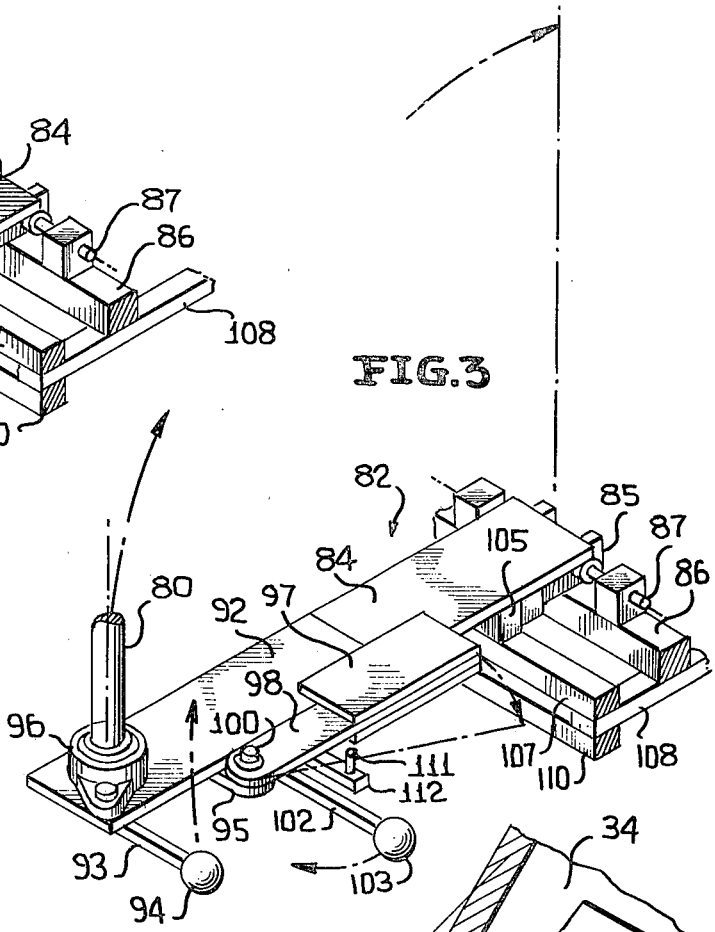
FIG.8
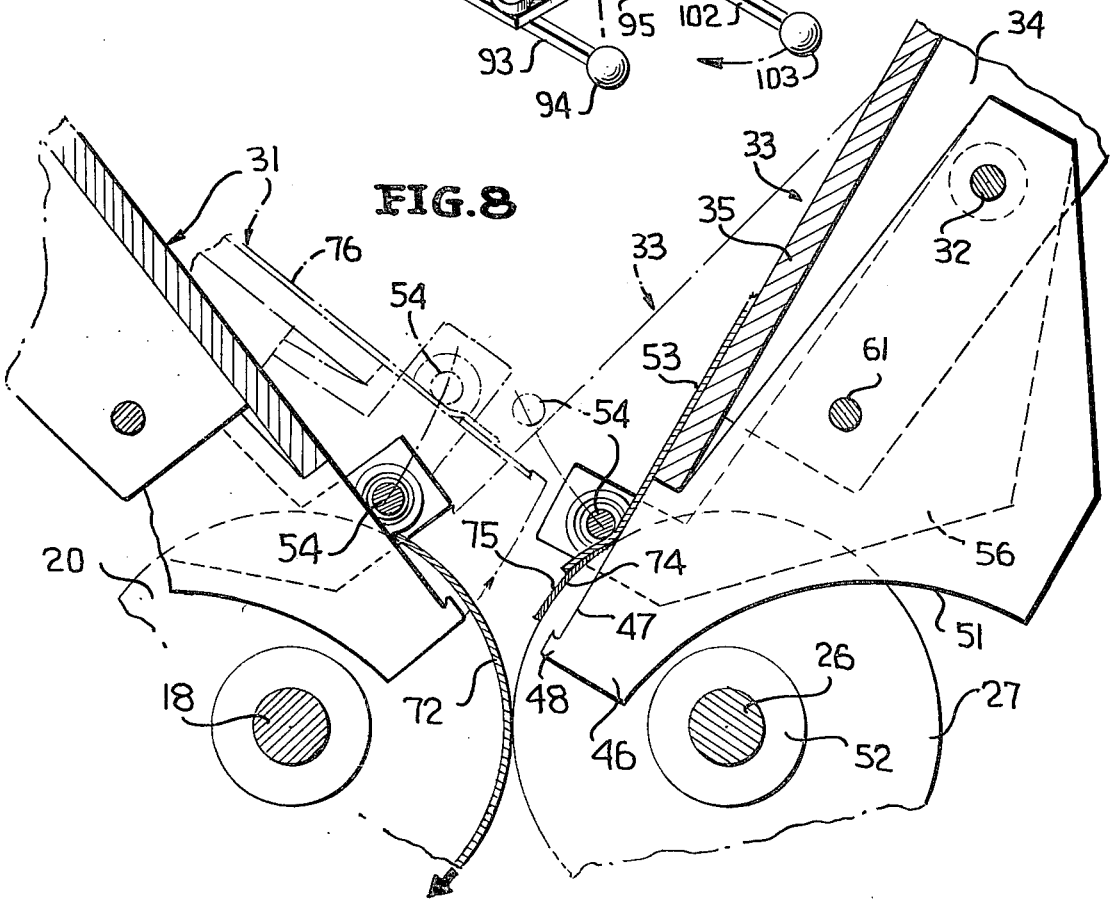

WEB SPLICER

This invention relates in general to new and useful improvements in web splicers, and more particularly to a web splicer suitable for the splicing of a new web to a running web wherein the webs are formed of plastics material.

It is well known to provide automatic web splicers. It is also well known to provide adhesive means to effect the automatic splicing of one web with respect to another. However, known web splicers which function automatically are of relatively cumbersome and expensive.

In accordance with this invention, a running web is passed between two rolls defining a nip. A new web is provided with a splice strip or joint strip which has a pressure sensitive adhesive coating on one surface thereof. The splice strip is presented into the nip between the two rolls in opposed relation to the running web so as to be automatically adhered thereto.

One of the primary features of the invention is the ability to present the splice strip automatically to the rolls. In order to accomplish this, the support for the new web includes a plurality of fingers which accurately position the splice strip and these fingers are aligned with annular grooves in the associated one of the rolls so that when it is desired to present the splice strip to the associated roll, the fingers may move down into the roll and engage the splice strip and new web to the moving surface of the roll for movement into the nip thereby.

Another feature of the invention is that the same type of support may be duplicated with respect to the other of the rolls and these supports, although they overlap one another, can be sequentially presented to the rolls, clearing one another, whereby either one of the webs may be the running web and the other of the webs may be the new web.

Another feature of this invention is the provision of a novel support for a roll of web material. In machines of the type to which this invention is particularly related, the roll of web material is positioned over the machine in an inaccessible position. In order to load a new web, the spindle for the web is movable from its elevated position overlying the machine to a lowered horizontal position along side of the machine so that the new web may be readily applied thereto. The web support is provided with two hinges in order to accomplish this. The first hinge permits the spindle to be moved to one side of the machine in a vertical position, and the second hinge permits the spindle to be swung from its vertical position to the lower horizontal position.

With the above and other objects in view that will hereinafter appear, the nature of the invention will be more clearly understood by reference to the following detailed description, the appended claimed subject matter, and the several views illustrated in the accompanying drawings.

IN THE DRAWINGS

FIG. 3 is a fragmentary perspective view showing the web supports pivoted from its operative web supporting position to an intermediate position.

FIG. 4 is a fragmentary perspective view of the web support of FIG. 3 where it is further pivoted to its lower horizontal position for the loading of a web thereon.

FIG. 8 is a diagrammatic view showing the manner in which a ready new web is initially fed into splicing engagement with a running web by one of the make-ready web supports in the manner in which a further new web will be carried by the other of the make-ready supports.

Figure 1:
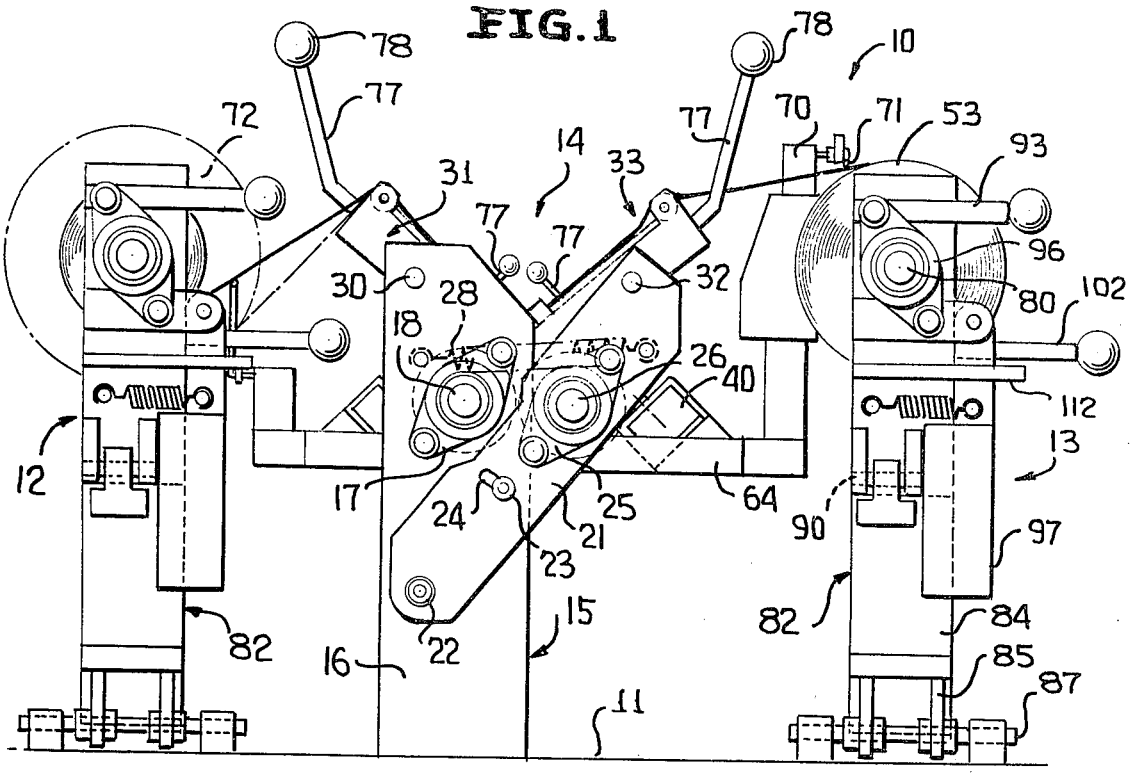
FIG. 1 is a side elevational view of a support and splicer arrangement for two webs in accordance with this invention.

Referring now to the drawings in detail, it will be seen that the web splicer is generally identified by the numeral 10. The web splicer 10 is mounted on a machine frame identified by the numeral 11. The web splicer 10 includes a pair of supports 12 and 13 for separate rolls of web material which are to be sequentially fed to the machine. In between the web supports 12 and 13 is a web splicing mechanism, generally identified by the numeral 14.

The web splicing mechanism 14 includes a support frame 15 extending upwardly at opposite sides of the machine. Each support frame includes a main support member 16 which is rigidly mounted with respect to the machine frame 11 and which is provided with a bearing member 17 which supports for rotation a shaft 18 of a roll 20.

Pivotally carried by each main support 16 is an auxiliary support 21, the auxiliary support 21 being mounted on a pivot 22 carried by its respective main support. The auxiliary support 21 is also positioned by means of a fastener 23 carried by the main support 16 and slightly movable within a slot 24 in the auxiliary support 21.

The auxiliary support 21 also carries bearing elements 25 which support for rotation a shaft 26 of a second roll 27.

A tension spring 28 extends between each main support 16 and its auxiliary support 21 and urges the rolls 20 and 27 together. Thus a web or webs running between the rolls 20, 27 are grasped by the rolls. The rolls 27 are preferably formed of a resilient material.

The upper portions of the main support 16 have extending therebetween a pivot shaft 30. Pivotally mounted on the pivot shaft 30 is a make-ready unit, generally identified by the numeral 31. The auxiliary support 21 also carries a pivot shaft 32 and pivotally mounted on a pivot shaft 32 is a make-ready unit, generally identified by the numeral 33. The make-ready units 31 and 33 are of identical constructions and, accordingly, only the make-ready unit 33 will be described in detail hereinafter.

Make-ready unit 33 includes a pair of side plates 34 which are joined together by a web supporting plate 35.

The side plates 34 are directly pivotally mounted on the pivot shaft 32.

The upper rear corners of each of the side plates 34 is provided with an extension 36 and the extension 36 are provided with a shaft 37 extending therebetween on which a web support roll 38 is rotatably mounted.

Associated with each side plate 34 is a positioning device which in the preferred embodiment is in the form of a linerar extensible solenoid device 40 having a plunger shaft 41. When the solenoid device 40 is not energized, the plunger shaft 41 projects upwardly therefrom and holds the side plates 34 and the web support plate 35 in an upper position through suitable linkage. When the solenoid devices 40 are energized, the plunger shafts 41 thereof are pulled downwardly so as to pull the side plates and web support plate 35 downwardly with the same pivoting about the pivot shaft 32.

Carried by each side plate 34 is a bracket 42. Each bracket 42 has pivotally connected thereto a link 43. The opposite end of each link is pivotally connected to a triangular crank member 44. Each triangular crank member 44 is pivotally mounted on the support shaft 32. A further link 45 connects the crank 44 to the plunger shaft 41. The relationship of the crank 44 with respect to the plunger shaft 41 and the bracket 42 provides for the desired pivotal movement of the side plates 34 and the web support plate 35.

Suitably mounted at the underside of the web support plate 35 and projecting forwardly therefrom is a plurality of fingers 46. The fingers 46 are spaced transversely of the roll 27 and, as is best shown in FIG. 8, each finger 46 has a primary upper surface 47 which is co-planar with the upper surface of the associated web support plate 35. The terminal end of each finger 46 has an upstanding projecting 48 which functions as a stop.

Figures 5, 6, 7:
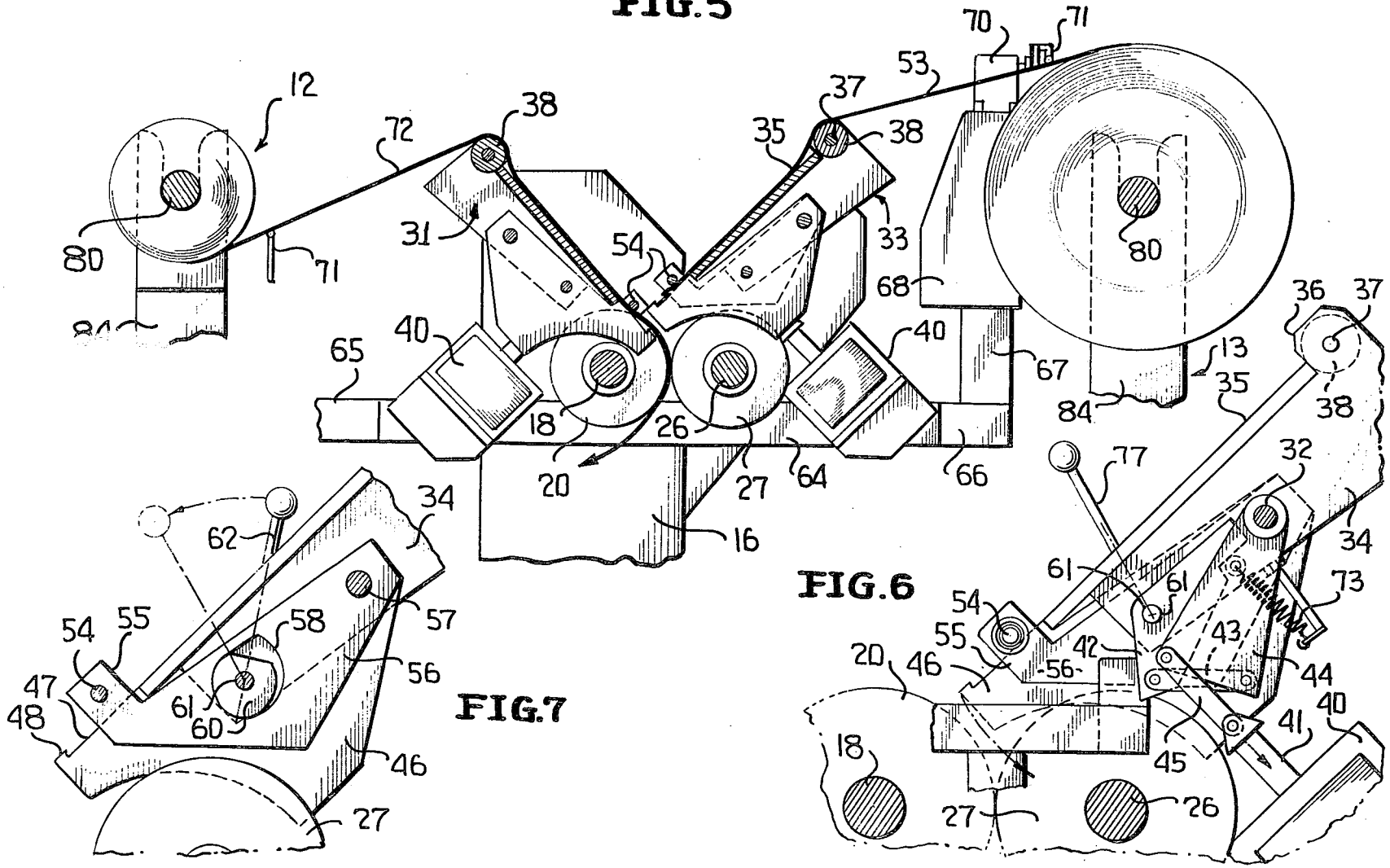
FIG. 5 is a longitudinal sectional view taken through the device and shows specifically the details thereof and the relationship of a make-ready web with respect to a running web.
FIG. 6 is an enlarged fragmentary diagrammatic view showing the specific details of the mounting of the make-ready support for the web and the linkage for moving the same from an inoperative position to an operative position.
FIG. 7 is a diagrammatic view showing the mounting of the hold down roll and the means for moving the same between an elevated position permitting the feeding of a web and a lowered position holding the web in place on the support in a ready position.

The roll 27 is provided with a plurality of annular grooves 50 therein which are aligned with respective ones of the fingers 46. As is best shown in FIG. 8, the lower forward part of each finger 46 includes an arcuate surface 51 which is configurated so that when the make-ready unit 33 is moved downwardly for cooperation with the rolls 27, the fingers will clear the shaft 26 and central hub portion 52 thereof. On the other hand, when the make-ready unit 33 is in its elevated position, as shown in FIG. 7, only the trailing portion of each finger 46 is positioned within the groove of the roll 27. Thus there is no problem of entry of the fingers 46 into the grooves 50.

In order that a new web, the web 53, may be accurately positioned on the web support plate 35, there is provided a hold down roll 54. The hold down roll 54 is rotatably journaled at its ends in a pair of arms 55 which are upper forward portions of a pair of plates 56 disposed immediately transversely inwardly of the side plates 34 and pivotally mounted on a pivot rod 57 carried by the side plates 34. Each plate 56 has formed therein a cam opening 58 in which there is positioned a cam 60 mounted on a transverse shaft 61 carried by the side plates 34. A lever 62 is secured to one end of the shaft 61 for rotating the cam 60.

With reference to FIG. 5, it will be seen that at each side of the device there is a longitudinal frame member 64 suitably carried by the primary supports 16. The frame members 64 carry the solenoid devices 40. Further, the frame member 64 at the side of the device remote from that shown in FIG. 1 is provided with extensions 65 and 66. Each of these extensions carries an upstanding support 67 which, in turn, carries a bracket 68 having a switch 70 mounted thereon. Each switch 70 has an actuator arm 71 which extends transversely of the machine and engages the respective web to detect the end of the web.

Assuming that the web carried by the web support 12 is the running web, that web will extend down between the rolls 20, 27 and extend forwardly along the machine for use. The running web is identified by the numeral 72. The running web 72 extends over the roll 38 of its make-ready unit 31 and down under the roll 54 in between the rolls 20, 27. The make-ready unit 31 has been drawn down into its operative position by the associated solenoid devices 40 as is clearly shown in FIG. 5. The make-ready unit 33 is in its elevated position. If desired, the make-ready units may be held in elevated positions by means of suitable springs, such as the spring 73 illustrated in FIG. 6.

The new web 53 extends under the associated switch actuator 71 and over the associated roll 38 onto the upper surface of the web support plate 35. As is best illustrated in FIG. 8, the new web 53 has secured to the underside of the leading portion thereof the upper surface of a splice strip 74. The upper surface of the splice strip 74 is provided with a pressure sensitive adhesive coating 75. Thus the exposed face of the splice strip 74 has an adhesive coating thereon which may bond the same to the running web 72.

It is to be understood that the new web 53 is positioned with respect to the make-ready units 33 with the splice strip 74 resting upon the fingers 46 and with the leading edge thereof engaging the stops 48 of the fingers so as to properly position the splice strip 74. Immediately rearwardly of the splice strip 74, the leading portion of the new web 53 is clamped against the surface 47 of the fingers by the roll 54.

At this time it is pointed out that the switch 70 associated with the web 53 is in an electrical system with the solenoid devices 40 of the make-ready unit 31 in such a manner when actuated, the solenoid devices 40 will be energized. In a like manner, it is to be understood that the switch 70 associated with the running web 72 controls the actuation of the solenoid devices 40 of the make-ready unit 33. It will be seen that the make-ready unit 31 is in its down position and the make-ready unit 33 is in its up position.

With reference to FIG. 8, it will be seen that the running web 72 is in the last stage of being exhausted and has separated from its support and the switch associated therewith has been actuated so as to actuate the solenoid devices 40 of the make-ready unit 33. The solenoid devices 40 of the make-ready unit 33 is drawn the same downwardly so as to engage the splice strip 74 with the periphery of the roll 27 for feeding thereby. It is further to be noted that the hold down roll 54 now directly opposes the surface of the roll 27 so as to clamp the leading portion of the new web 53 between the roll 54 and the roll 27. Thus the new web 53 is fed down into the nip between the rolls 20, 27 with the result that the adhesive coating 75 of the splice strip 74 is brought into face-to-face engagement with the outer surface of the running web 72 and the new web 53 is bonded to the running web 72 in back-to-back relation. Preferably the amount of overlap between the two webs is on the order of 2–3 inches.

After the new web 53 becomes the running web, replacing the web 72 as the running web, it is necessary to load a new roll of web material on the support 12 and to provide the same with a splice strip 74. Such a further new web is identified by the numeral 76 and illustrated in FIG. 8 in phantom lines in the position which it will assume with the make-ready unit 31 after it has been moved out of operative engagement with the roll 20. In order to facilitate the movement of the make-ready units 31, 33 to their elevated positions, each is provided with a lift arm 77 having a suitable handle 78 thereon.

It is to be understood that the web roll supports 12 and 13 are identical. Accordingly, only the web roll support 13 will be described in detail.

Figure 2:
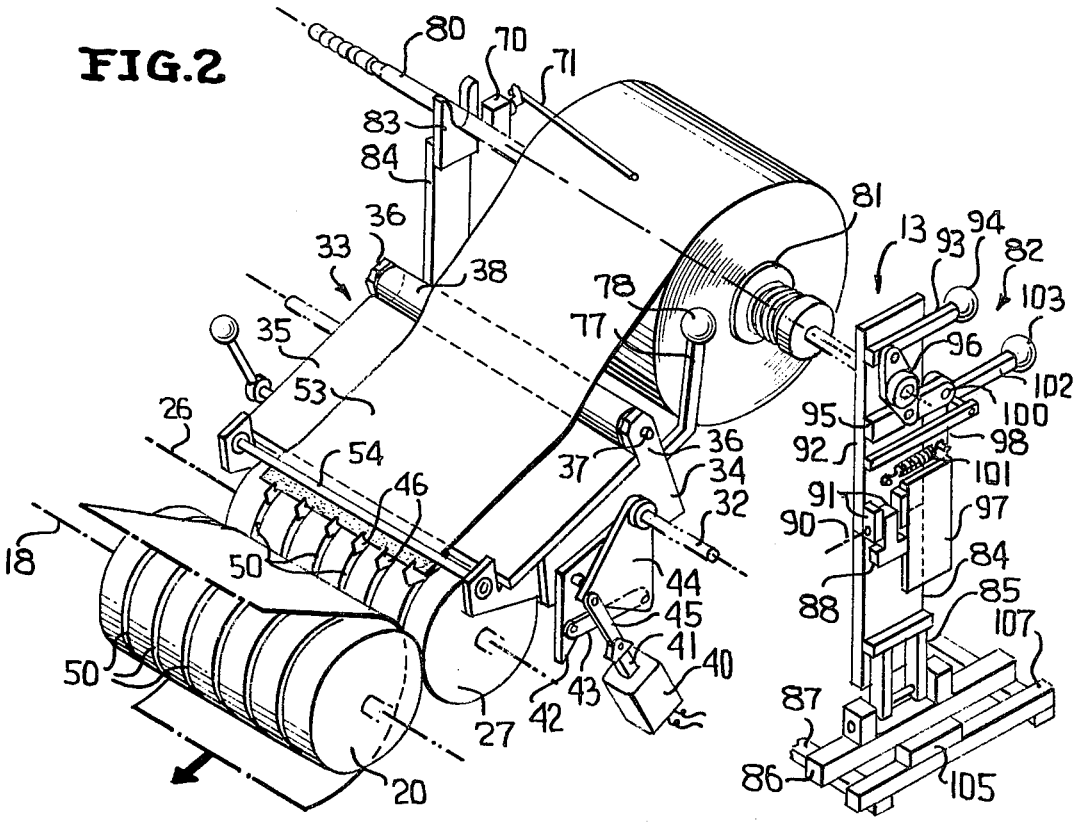
FIG. 2 is a top perspective view with parts omitted showing more specifically the details of the web splicer and the web support.

As is best shown in FIG. 2, the web roll support 13 includes a spindle 80 which will be provided with suitable roll support means 81 mounting the associated web roll for rotation. The spindle 80 is carried by a hinged support, generally identified by the numeral 82, and has the opposite end thereof seated in a bifurcated support bracket 83 carried by an upstanding support member 84.

The hinged support 82 includes a support arm 84 which is provided at the lower end thereof with a hinged bracket 85 projecting downwardly therefrom and being hingedly connected to a mounting bracket 86 by means of a hinged end 87. The mounting bracket 86 is suitably secured to the frame 11 in any desired manner.

The upper end of the support arm 84 is provided with a hinge bracket 88 which is connected by means of a hinge pin 90 to hinge brackets 91 carried by the lower end of an upper support arm 92. The upper support arm 92 is provided at the upper end thereof with a lift arm 93 having a handle mounted thereon. Below the lift arm 93 is a pivot bracket 95 which is generally parallel to the lift arm 93. Secured to the upper support arm 92 in the vicinity of the lift arm 93 and the pivot bracket 95 is a bearing unit 96 for the spindle 80.

In order that the support arm 92 may normally be a continuation of the support arm 84, extending across the opposed ends of the support arms 84, 92 is a pair of plates 97. Disposed between the plates 97 is a support arm 98 which is of substantially the same thickness as the arms 84, 92. The upper end of the support arm 98 is pivotally connected to the pivot bracket 95 by means of a pivot pin 100. A spring 101 constantly urges the support arm 98 against the arms 84, 92 so as to hold the plates 97 in position.

In order that the plates 97 may be moved out of position against the edging of the spring 101, the support arm 98 is provided with a handle 102 which is provided with a grip knob 103.

Referring now to FIG. 3 in particular, it will be seen that when the handle 102 is gripped and pulled transversely of the machine, the spindle 80 and the remainder of the hinged support 82 will swing about the hinge or pivot pin 87 through an angle of 90° until the flat surface of the support arm 85 bears against a resilient bumper member 105 carried by a frame member 107. The frame member 107 overlies other ends of transverse frame members 108 which are secured to the underside of the hinge bracket 86. A further frame member 110 underlies the frame member 107 and is secured to the underside of each of the transverse frame members 108.

When the hinged support 82 assumes its horizontal position, the support arms 84 and 92 are horizontally disposed with the result that the spindle 80 is vertically disposed. It is not feasible to load a new web roll onto the spindle when it is in its vertical position. It is therefore desirable that the spindle 80 be pivoted once again through an angle of 90° so that it may be disposed outwardly of the machine of which the frame 11 is a part and in a horizontal position at a height readily accessible to an operator. Accordingly, the handle 102 is actuated to swing the plates 97 to a position spaced from the support arms 84, 92, thus releasing the support arm 92 for hinging about its hinge pin 90. Outward swinging of the support arm 98 relative to the support arm 92 is limited by means of a stop pin 111 carried by a bracket 112.

As shown in FIG. 4, hinging of the support arm 92 about the hinge pin 90 results in the support arm 92 assuming a depending vertical position with respect to the support arm 84 while the spindle 80 assumes an outwardly projecting horizontal position, in which position a new roll of web may be positioned thereon.

With further reference to FIG. 4, it is to be noted that the support arm 84 is provided with a projecting plate 113 and that the support arm 92 is provided with a notch 114 in alignment with the projecting portion of the projecting plate 113. The projecting portion of the plate 113 engages the support arm 92 and inhibits the pivoting thereof about the hinge pin 90 so as to prevent a sudden dropping of the support arm 92 when the plates 97 are moved to their inoperative positions.

At this time it is also pointed out that if desired, a protective covering may be provided for the opposed ends of the support arms 84 and 92 so as to prevent an operator from having his finger or other part of his body pinched between the support arms 84, 92 when they are moved to their planar position.

At this time it is pointed out that when the new roll of web is positioned on a lower spindle 80, it is now feasible to apply the splice strip 74 to the free end of the web. When the web roll is being mounted on the support 12, looking at the end of the spindle, the material will be wound in a clockwise direction and the splice strip will be applied to the vent upper surface of the free end portion of the web. On the other hand, when the web roll is being mounted on the sprindle of the support 13, looking at the end of the spindle the web material will also be wound counter-clockwise, but the splice strip will be applied to the underside of the terminal portion of the web.

It will be understood that none of the splice mechanism 14 or the supports 12, 13 will in any way interfere with the running web and the operator will have ample space within which to first load a new roll and then position the leading portion thereof and the splice strip secured thereto with respect to the associated make-ready unit.

Although only a preferred embodiment of the splice mechanism and supports has been specifically illustrated and described herein, it is to be understood that minor variations may be made in the mechanism without departing from the spirit and scope of the invention, as defined by the appended claims.

What is claimed as new:

1. For use in a web splicer, a make-ready unit comprising a support, means mounting said support for pivotal movement, said support having a terminal edge portion remote from said mounting means, said terminal edge portion being in the form of a plurality of fingers spaced transversely of said support and forming a longitudinal extension of said support, at least certain of said fingers having terminal stop means remote from said support for longitudinally positioning a starter web on said support, and hold down means carried by said support for holding a new web on said support.

2. The device of claim 1 together with positioning means for moving said unit between a make-ready position and a running position.

3. The device of claim 1 wherein there is a web roll, said fingers overlap said web roll, said web roll being grooved in alignment with said fingers, and said fingers upon pivoting of said support being movable into said web roll in recessed relation for directing a starter web against said web roll to initiate feeding of a new web.

4. The device of claim 3 wherein said hold down means is a roll overlying said finger and cooperable with said web roll when said fingers move into said web roll.

5. The device of claim 1 wherein there are two web rolls mounted in cooperating web feeding relation and defining a nip therebetween, said fingers overlap one of said web rolls, said one web roll being adjacent said support and being grooved in alignment with said fingers, and said fingers upon pivoting of said support being movable into said one web roll in recessed relation for directing a starter web directly into said nip by said one roll and into adhered engagement with a running web passing through said nip.

6. The device of claim 5 together with positioning means for moving said unit between a make-ready position and a running position.

7. The device of claim 5 wherein there is a second of said make-ready unit positioned for cooperation with the other of said web rolls, and said other web roll having grooves therein for reception of fingers of said second make-ready unit.

8. The device of claim 7 wherein the grooves in said web rolls are in alignment.

9. The device of claim 5 wherein said running web enters said nip around the other of said rolls.

10. For use in a web splicer, a make-ready unit comprising a support, means mounting said support for pivotal movement, said support having a terminal edge portion remote from said mounting means, said terminal edge portion being in the form of a plurality of fingers spaced transversely of said support, at least certain of said fingers having terminal stop means for positioning a starter web, and hold down means carried by said support for holding a new web on said support, said mounting means being supported in an elevated position by a machine frame; and a web support spindle for supporting a new web in roll form, support means for supporting said spindle from said frame in an elevated position, said support means comprising a fixed support for releasably receiving one end of said spindle and a support arm rigidly connected to the other end of said spindle, first hinge means connecting said support arm to said frame for swinging movement of said spindle from a horizontal operative position to a vertical intermediate position, said support arm being of a two piece construction and second hinge means arranged parallel to said first hinge means hingedly connecting said support arm pieces together for the relative movement thereof to a position wherein said spindle is in a horizontal web round receiving position to one side of said frame and materially below said horizontal operative position.

11. The device of claim 10 together with latch means carried by one of said support arm pieces and engageable with the other of said support arm pieces for selectively rendering said second hinge means inoperative.

12. A web feed and splicing arrangement comprising a pair of cooperating feed rolls defining a continuously formed nip, first and second web support means for mounting webs in roll form on opposite sides of said nip, and web splicing means mounted adjacent said feed rolls for directing a web splice directly in said nip, said web splicing means including a separate splice forming unit individually associated with each of said feed rolls, each splice forming unit being in the form of a make ready unit comprising a support, means mounting said support for pivotal movement, said support having a terminal edge portion remote from said mounting means, said terminal edge portion being in the form of a plurality of fingers spaced transversely of said support and forming a longitudinal extension of said support, at least certain of said fingers having terminal stop means remote from said support for longitudinally positioning a starter web, and hold down means carried by said support for holding a new web on said support.

* * * * *